US010490208B2

(12) United States Patent
Steele et al.

(10) Patent No.: US 10,490,208 B2
(45) Date of Patent: Nov. 26, 2019

(54) FLEXIBLE VOICE CAPTURE FRONT-END FOR HEADSETS

(71) Applicant: Cirrus Logic International Semiconductor Ltd., Edinburgh (GB)

(72) Inventors: Brenton Robert Steele, Cremorne (AU); Hu Chen, Cremorne (AU); Ben Hutchins, Cremorne (AU)

(73) Assignee: Cirrus Logic, Inc., Austin, TX (US)

( * ) Notice: Subject to any disclaimer, the term of this patent is extended or adjusted under 35 U.S.C. 154(b) by 0 days.

(21) Appl. No.: 15/946,245

(22) Filed: Apr. 5, 2018

(65) Prior Publication Data

US 2018/0294000 A1 Oct. 11, 2018

Related U.S. Application Data

(60) Provisional application No. 62/483,615, filed on Apr. 10, 2017.

(51) Int. Cl.
*G10L 25/84* (2013.01)
*G10K 11/175* (2006.01)
(Continued)

(52) U.S. Cl.
CPC ..... *G10L 25/84* (2013.01); *G10K 11/175* (2013.01); *G10K 11/346* (2013.01); *G10L 21/0208* (2013.01); *G10L 25/78* (2013.01); *H04R 1/1083* (2013.01); *H04R 3/005* (2013.01); *G10K 2210/1081* (2013.01); *G10L 25/30* (2013.01);
(Continued)

(58) Field of Classification Search
CPC ..... G10L 25/84; G10L 21/0208; G10L 25/78; G10L 25/30; G10L 2021/02166; G10K 11/175; G10K 11/346; G10K 2210/1081; H04R 1/1083; H04R 3/005; H04R 1/406;
(Continued)

(56) References Cited

U.S. PATENT DOCUMENTS 8,340,309 B2 12/2012 Burnett et al.
8,542,843 B2 9/2013 Andrea et al.
(Continued)

OTHER PUBLICATIONS

Combined Search and Examination Report, UKIPO, Application No. GB1708372.6, dated Nov. 24, 2017.

*Primary Examiner* — Quynh H Nguyen
(74) *Attorney, Agent, or Firm* — Jackson Walker L.L.P.

(57) ABSTRACT

A signal processing device for configurable voice activity detection. A plurality of inputs receive respective microphone signals. A microphone signal router configurably routes the microphone signals. At least one voice activity detection module receives a pair of microphone signals from the router, and produces a respective output indicating whether speech or noise has been detected by the voice activity detection module in the respective pair of microphone signals. A voice activity decision module receives the output of the voice activity detection module(s) and determines whether voice activity exists in the microphone signals. A spatial noise reduction module receives microphone signals from the microphone signal router, and performs adaptive beamforming based in part upon the output of the voice activity decision module, and outputs a spatial noise reduced output. The device permits simple configurability to deliver spatial noise reduction for one of a wide variety of headset form factors.

20 Claims, 9 Drawing Sheets

(51) Int. Cl.

| | |
|---|---|
| ***H04R 3/00*** | (2006.01) |
| ***G10L 21/0208*** | (2013.01) |
| ***G10L 25/78*** | (2013.01) |
| ***H04R 1/10*** | (2006.01) |
| ***G10K 11/34*** | (2006.01) |
| ***G10L 25/30*** | (2013.01) |
| ***G10L 21/0216*** | (2013.01) |
| ***H04R 1/40*** | (2006.01) |

(52) U.S. Cl.
CPC .... *G10L 2021/02166* (2013.01); *H04R 1/406* (2013.01); *H04R 2201/401* (2013.01); *H04R 2201/403* (2013.01); *H04R 2430/23* (2013.01); *H04R 2430/25* (2013.01)

(58) Field of Classification Search
CPC ..... H04R 2201/401; H04R 2430/23; H04R 2430/25; G04R 2201/403
USPC ..... 704/233
See application file for complete search history.

(56) References Cited

U.S. PATENT DOCUMENTS

| | | | | |
|---|---|---|---|---|
| 8,976,957 | B2 | 3/2015 | Pavlov et al. | |
| 2004/0161121 | A1* | 8/2004 | Chol | G10L 21/0208 381/92 |
| 2007/0088544 | A1 | 4/2007 | Acero et al. | |
| 2008/0260180 | A1 | 10/2008 | Goldstein et al. | |
| 2010/0004929 | A1 | 1/2010 | Baik | |
| 2014/0023199 | A1 | 1/2014 | Giesbrecht | |
| 2017/0092297 | A1* | 3/2017 | Sainath | G10L 25/78 |

* cited by examiner

FLEXIBLE VOICE CAPTURE FRONT-END FOR HEADSETS

TECHNICAL FIELD

The present invention relates to headset voice capture, and in particular to a system which can be simply configured to provide voice capture functions for any one of a plurality of headset form factors, or even for a somewhat arbitrary headset form factor, and a method of effecting such a system.

BACKGROUND OF THE INVENTION

Headsets are a popular way for a user to listen to music or audio privately, or to make a hands-free phone call, or to deliver voice commands to a voice recognition system. A wide range of headset form factors, i.e. types of headsets, are available, including earbuds, on-ear (supraaural), over-ear (circumaural), neckband, pendant, and the like. Several headset connectivity solutions also exist including wired analog, USB, Bluetooth, and the like. For the consumer it is desirable to have a wide range of choice of such form factors, however there are numerous audio processing algorithms which depend heavily on the geometry of the device as defined by the form factor of the headset and the precise location of microphones upon the headset, whereby performance of the algorithm would be markedly degraded if the headset form factor differs from the expected geometry for which the algorithm has been configured.

The voice capture use case refers to the situation where the headset user's voice is captured and any surrounding noise is minimised. Common scenarios for this use case are when the user is making a voice call, or interacting with a speech recognition system. Both of these scenarios place stringent requirements on the underlying algorithms. For voice calls, telephony standards and user requirements demand that high levels of noise reduction are achieved with excellent sound quality. Similarly, speech recognition systems typically require the audio signal to have minimal modification, while removing as much noise as possible. Numerous signal processing algorithms exist in which it is important for operation of the algorithm to change in response to whether or not the user is speaking. Voice activity detection, being the processing of an input signal to determine the presence or absence of speech in the signal, is thus an important aspect of voice capture and other such signal processing algorithms. However voice capture is particularly difficult to effect with a generic algorithm architecture.

There are many algorithms that exist to capture a headset user's voice, however such algorithms are invariably designed and optimised specifically for a particular configuration of microphones upon the headset concerned, and for a specific headset form factor. Even for a given form factor, headsets have a very wide range of possible microphone positions (microphones on each ear, whether internal or external to the ear canal, multiple microphones on each ear, microphones hanging around neck, and so on). FIG. 1 shows some examples of the many possible microphone positions that may each require a voice capture function. In FIG. 1 the black dots signify microphones that are present in a particular design, while the open circles indicate unused microphone locations. As can be seen, with such a proliferation of form factors and available microphone positions, the number of voice capture solutions that need to be developed and tested can quickly become difficult to manage. Likewise, tuning can become very difficult, as each solution may need to be tuned in a different way and require highly skilled engineer time, increasing costs.

Any discussion of documents, acts, materials, devices, articles or the like which has been included in the present specification is solely for the purpose of providing a context for the present invention. It is not to be taken as an admission that any or all of these matters form part of the prior art base or were common general knowledge in the field relevant to the present invention as it existed before the priority date of each claim of this application.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

In this specification, a statement that an element may be "at least one of" a list of options is to be understood that the element may be any one of the listed options, or may be any combination of two or more of the listed options.

SUMMARY OF THE INVENTION

According to a first aspect, the present invention provides a signal processing device for configurable voice activity detection, the device comprising:

a plurality of inputs for receiving respective microphone signals;

a microphone signal router for routing microphone signals from the inputs;

at least one voice activity detection module configured to receive a pair of microphone signals from the microphone signal router, and configured to produce a respective output indicating whether speech or noise has been detected by the voice activity detection module in the respective pair of microphone signals;

a voice activity decision module for receiving the output of the at least one voice activity detection module and for determining from the output of the at least one voice activity detection module whether voice activity exists in the microphone signals, and for producing an output indicating whether voice activity exists in the microphone signals;

a spatial noise reduction module for receiving microphone signals from the microphone signal router, and for performing adaptive beamforming based in part upon the output of the voice activity decision module, and for outputting a spatial noise reduced output.

According to a second aspect the present invention provides a method for configuring a configurable front end voice activity detection system, the method comprising:

training an adaptive block matrix of a generalised sidelobe canceller of the system by presenting the system with ideal speech detected by microphones of a headset having a selected form factor; and copying settings of the trained adaptive block matrix to a fixed block matrix of the generalised sidelobe canceller.

A computer readable medium for fitting a configurable voice activity detection device, the computer readable medium comprising instructions which, when executed by one or more processors, causes performance of the following:

configuring routing of microphone inputs to voice activity detection modules; and configuring routing of microphone inputs to a spatial noise reduction module.

In some embodiments of the invention, the spatial noise reduction module comprises a generalised sidelobe canceller module. In such embodiments, the generalised sidelobe canceller module may be provided with a plurality of generalised sidelobe cancellation modes, and made to be configurable to operate in accordance with one of said modes.

In embodiments comprising generalised sidelobe canceller module, the generalised sidelobe canceller module may comprise a block matrix section comprising:

a fixed block matrix module configurable by training; and an adaptive block matrix module operable to adapt to microphone signal conditions.

In some embodiments of the invention, the signal processing device may further comprise a plurality of voice activity detection modules. For example, the signal processing device may comprise four voice activity detection modules. The signal processing device may comprise at least one level difference voice activity detection module, and at least one cross correlation voice activity detection module. For example, the signal processing device may comprise one level difference voice activity detection module, and three cross correlation voice activity detection modules.

In some embodiments of the present invention, the voice activity decision module comprises a truth table. In some embodiments, the voice activity decision module is fixed and non-programmable. In other embodiments, the voice activity decision module is configurable when fitting voice activity detection to the device. The voice activity decision module in some embodiments may comprise a voting algorithm. The voice activity decision module in some embodiments may comprise a neural network.

In some embodiments of the invention, the signal processing device is a headset.

In some embodiments of the invention, the signal processing device is a master device interoperable with a headset, such as a smartphone or a tablet.

In some embodiments of the invention, the signal processing device further comprises a configuration register storing configuration settings for one or more elements of the device.

In some embodiments of the invention, the signal processing device further comprises a back end noise reduction module configured to apply back end noise reduction to an output signal of the spatial noise reduction module.

BRIEF DESCRIPTION OF THE DRAWINGS

An example of the invention will now be described with reference to the accompanying drawings, in which.

DESCRIPTION OF THE PREFERRED EMBODIMENTS

Figure 1:
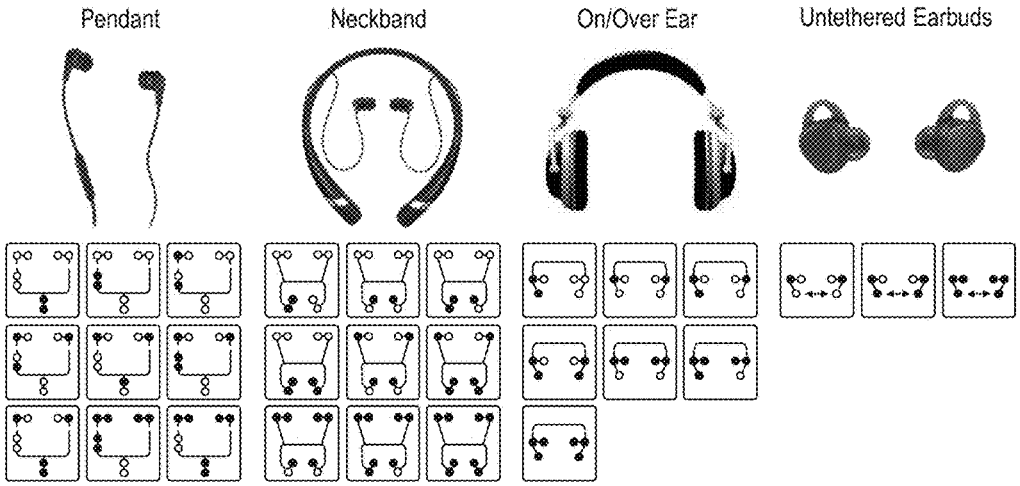
FIG. 1 shows examples of headset form factors, and some possible microphone positions for each form factor.
Figure 2:
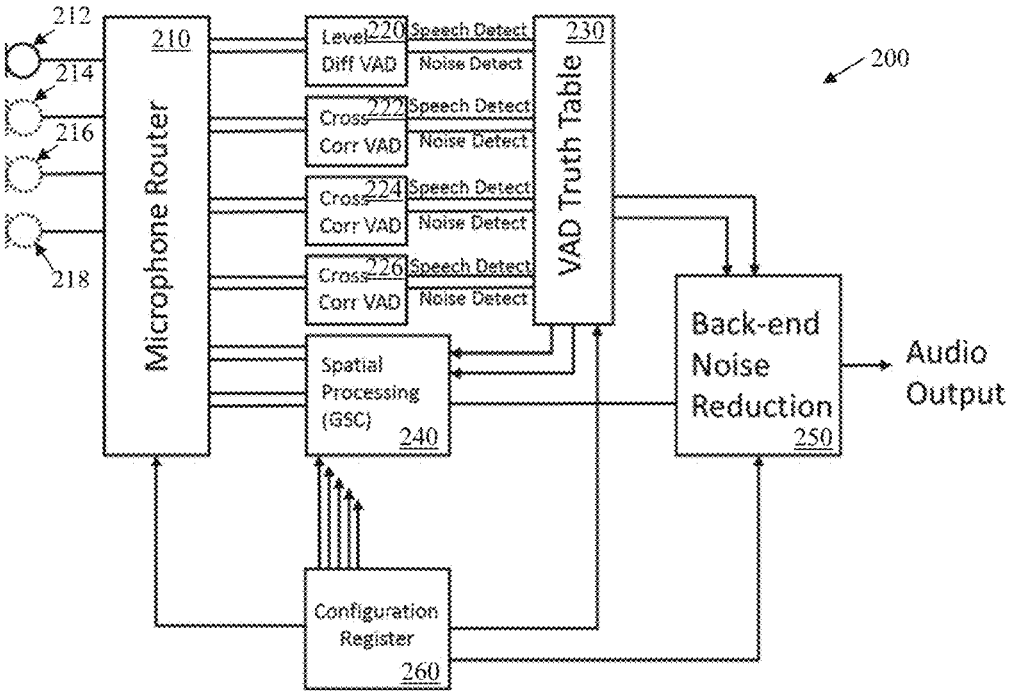
FIG. 2 illustrates the architecture of a configurable system for front-end voice capture in accordance with one embodiment of the invention.

The overall architecture of a system 200 for front-end voice capture is shown in FIG. 2. The system 200 of this embodiment of the invention comprises a flexible architecture for front-end voice capture that can be deployed upon any one of a range of headset form factors, ie. types of headsets, including for example those shown in FIG. 1. The system 200 is flexible in the sense that the operation of the front-end voice capture can be simply customised or tuned to the form factor of the particular headset platform involved, in order for that headset to be optimally configured to capture a user's voice, without requiring a bespoke front-end voice capture architecture to be engineered for each different headset form factor. Notably, the system 200 is designed as a single solution which can be deployed on headsets having a wide range of form factors and/or microphone configurations.

In more detail, the system 200 comprises a microphone router 210 operable to receive signals from up to four microphones 212, 214, 216, 218 via digital pulse density modulation (PDM) input channels. The provision of four microphone input channels in this embodiment reflects the digital audio interface capabilities of the digital signal processing core selected, however the present invention in alternative embodiments may be applied to DSP cores supporting greater or fewer channels of microphone inputs and/or microphone signals could also come from analog microphones via an analog to digital converter (ADC). As graphically indicated by dotted lines in FIG. 2, microphones 214, 216, and 218 may or may not be present depending on the headset form factor to which the system 200 is being applied, such as those shown in FIG. 1. Moreover, the location and geometry of each microphone is unknown.

A further task of microphone router, i.e. microphone switching matrix, 210 arises due to the flexibility of the Spatial Processing block or module 240, which requires the microphone router 210 to route the microphone inputs independently to not only the voice activity detection modules (VADs) 220, 222, 224, 226 but also to the various generalised sidelobe canceller module (GSC) inputs.

The purpose of the microphone router 210 is to sit after the ADCs or digital mic inputs and route raw audio to the signal processing blocks or modules, i.e. algorithms, that follow based on a routing array. The router 210 itself is quite flexible and can be combined with any routing algorithms.

The microphone router 210 is configured (by means discussed in more detail below) to pass each extant microphone input signal to one or more voice activity detection (VAD) modules 220, 222, 224, 226. In particular, depending on the configuration of the microphone router 210, a single microphone signal may be passed to one VAD or may be copied to more than one VAD. The system 200 in this embodiment comprises four VADs, with VAD 220 being a level difference VAD and the VADs 222, 224 and 226 comprising cross correlation VADs. An alternative number of VADs may be provided, and/or differing types of VADs may be provided, in other embodiments of the invention. In particular, in some alternative embodiments a multiplicity of microphone signal inputs may be provided, and the microphone router 210 may be configured to route the best pair of microphone inputs to a single VAD. However the present embodiment provides four VADs 220, 222, 224, 226, as the inventors have discovered that providing three cross correlation VADs and one level difference VAD is particularly beneficial in order for the architecture of system 200 to deliver suitable flexibility to provide sufficiently accurate voice activity detection in respect of a wide range of headset form factors. The VADs chosen cover most of the common configurations.

Each of the VADs 220, 222, 224, 226 operates on the two respective microphone input signals which are routed to that VAD by the microphone router 210, in order to make a determination as to whether the VAD detects speech or noise. In particular, each VAD produces one output indicating if speech is detected, and a second output indicating if noise is detected, in the pair of microphone signals processed by that VAD. The provision for two outputs from each VAD allows each VAD to indicate in uncertain signal conditions that neither noise nor speech has been confidently detected. Alternative embodiments may however implement some or all of the VADs as having a single output which indicates either speech detected, or no speech detected.

The Level Difference VAD 220 is configured to undertake voice activity detection based on level differences in two microphone signals, and thus the microphone routing should be configured to provide this VAD with a first microphone signal from near the mouth, and a second microphone signal from further away from the mouth. The level difference VAD is designed for microphone pairs where one microphone is relatively closer to the mouth than the other (such as when one mic is on an ear and the other is on a pendant hanging near the mouth). In more detail, the Level Difference Voice Activity Detector algorithm uses full-band level difference as its primary metric for detecting near field speech from a user wearing a headset. It is designed to be used with microphones that have a relatively wide separation, where one microphone is relatively closer to the mouth than the other. This algorithm uses a pair of detectors operating on different frequency bands to improve robustness in the presence of low frequency dominant noise, one with a highpass cutoff of 200 Hz and the other with a highpass cutoff of 1500 Hz. The two speech detector outputs are OR'd and the two noise detectors are AND'd to give a single speech and noise detector output. The two detectors perform the following steps: (a) Calculate power on each microphone across the audio block; (b) Calculate the ratio of powers and smooth across time; (c) Track minimum ratio using a minima-controlled recursive averaging (MCRA) style windowing technique; (d) Compare current ratio to minimum. Depending on the delta, detect as noise, speech or indeterminate.

The Cross Correlation VADs 222, 224, 226 are designed to be used with microphone pairs that are relatively similar in distance from the user's mouth (such as a microphone on each ear, or a pair of mics on an ear), The first Cross Correlation VAD 222 is often used for cross-head VAD, and thus the microphone routing should be configured to provide this VAD with a first microphone signal from a left side of the head and a second microphone signal from a right side of the head. The second Cross Correlation VAD 224 is often used for left side VAD, and thus the microphone routing should be configured to provide this VAD with signals from two microphones on a left side of the head. The third Cross Correlation VAD 224 is often used for right side VAD, and thus the microphone routing should be configured to provide this VAD with signals from two microphones on a right side of the head. However, these routing options are simply typical options and the system 200 is flexible to permit alternative routing options depending on headset form factor and other variables.

In more detail, each Cross Correlation Voice Activity Detector 222, 224, 226 uses a Normalised Cross-Correlation as its primary metric for detecting near field speech from a user wearing a headset. Normalised Cross Correlation takes the standard Cross Correlation equation:

$$CC[n] = \sum_{m=-\infty}^{\infty} x_1[m]x_2[m+n]$$

Then normalises each frame by:

$$\frac{1}{\sqrt{\sum x_1^2}\sqrt{\sum x_2^2}}$$

The maximum of this metric is used, as it is high when non-reverberant sounds are present, and low when reverberant sounds are present. Generally, near-field speech will be less reverberant than far-field speech, making this metric a good near-field detector. The position of the maximum is also used to determine the direction of arrival (DOA) of the dominant sound. By constraining the algorithm to only look for a maximum in a particular direction of arrival, the DOA and Correlation criteria both be applied together in an efficient way. Limiting the search range of n to a predefined window and using a fixed threshold is an accurate way of detecting speech in low levels of noise, as the maximum normalised cross correlation is typically in excess of 0.9 for near-field speech. For high levels of noise however, the maximum normalised cross correlation for near-field speech is significantly lower, as the presence of off-axis, possibly reverberant noise biases the metric. Setting the threshold lower is not appropriate, as the algorithm would then be too sensitive in high SNRs. The solution is to introduce a minimum tracker that uses a similar windowing technique to that used in MCRA based noise reduction systems—in this case however a single value is tracked, rather than a set of frequency domain values. A threshold is calculated that is halfway between the minimum and 1.0. Extra criteria are applied to make sure that this value never drops too low. When microphones are used that are relatively closely spaced, an extra interpolation step is required to ensure that the desired look direction can be obtained. Upsampling the correlation result is a much more efficient way to perform the calculation, as compared to upsampling the audio before calculating the cross-correlation, and gives the exact same result. Linear interpolation is currently used, as it is very efficient and gives an answer that is very similar to upsampling. The differences introduced by linear upsampling have been found to make no practical difference to the performance of the overall system.

The outputs of these different VADS need to be combined together in an appropriate way to drive the adaption of the Spatial Processing 240 and the Back-end noise reduction 250. In order to do this in the most flexible way, a Truth Table is implemented that can combine these in any way necessary. VAD truth table 230 serves the purpose of being a voice activity decision module, by resolving the possibly conflicting outputs of VADs 220, 222, 224, 226 and producing a single determination as to whether speech is detected. To this end, VAD truth table 230 takes as inputs the outputs of all of the VADs 220, 222, 224, 226. VAD truth table is configured (by means discussed in more detail below) to implement a truth table using a look up table (LUT) technique. Two instances of a truth table are required, one for the speech detect VAD outputs, and one for the noise detect VAD outputs. This could be implemented as two separate modules, or as a single module with two separate truth tables. In each table there are 16 truth table entries, one for every combination of the four VADs. The module 230 is thus quite flexible and can be combined with any algorithms. This method accepts an array of VAD states and uses a look up table to implement a truth table. This is used to give a single output flag based on the value of up to four input flags. A default configuration might for example be a truth table which indicates speech only if all active VAD outputs indicate speech, and otherwise indicates no speech.

The present invention further recognises that spatial processing is also a necessary function which must be integrated into a flexible front end voice activity detection system. Accordingly, system 200 further comprises a spatial processing module 240, which in this embodiment comprises a generalised sidelobe canceller configured to undertake beamforming and steer a null to minimise signal power and thus suppress noise.

The VAD elements (220, 222, 224, 226 and 230) and Spatial Processing 240 are the two parts that are most dependent on microphone position, so these are designed to work in a very generic way with very little dependence on particular microphone position.

The Spatial Processing 240 is based on a Generalised Sidelobe Canceller (GSC) and has been carefully designed to handle up to four microphones mounted in various positions. The GSC is well suited to this application, as the present embodiments recognise that some of the microphone geometry can be captured in its Blocking Matrix by implementing the Blocking Matrix in two parts and fixing the configuration of one part (denoted FBMn in FIGS. 3*a*-3*g*) during a simple training phase and only allowing the other part (denoted ABMn in FIGS. 3*a*-3*g*) to adapt during operation. In alternative embodiments of the invention a separate fixed block matrix is not used, and the pretraining is instead used to initialise a single adaptive block matrix. The Generalised Sidelobe Canceller (GSC) is implemented as a System Object. It can process up to four input signals, and produce up to four output signals. This allows the module to be configured in one of seven modes as shown in FIGS. 3*a*-3*g*.

Figure 3A:
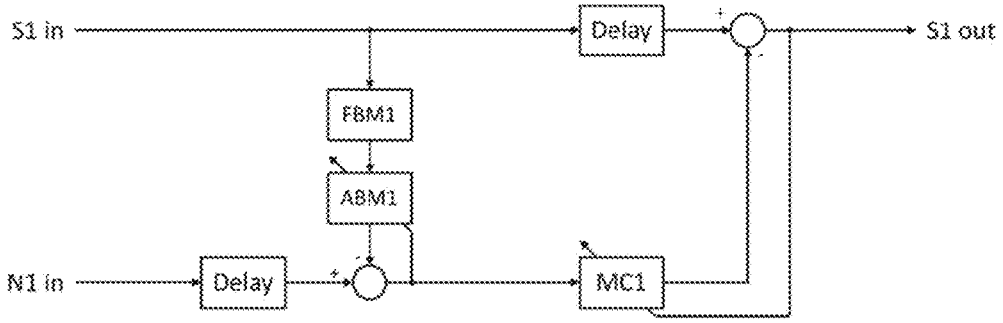
FIGS. 3*a*-3*g* illustrate the available modes of operation of the generalised sidelobe canceller of the system of FIG. 2.
Figure 3B:
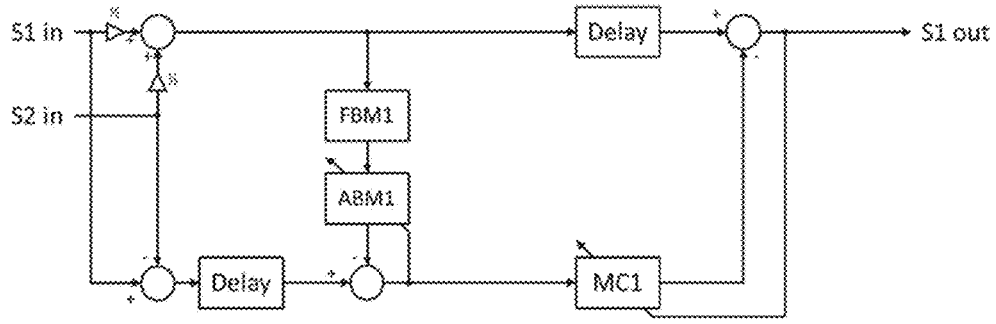
Figure 3C:
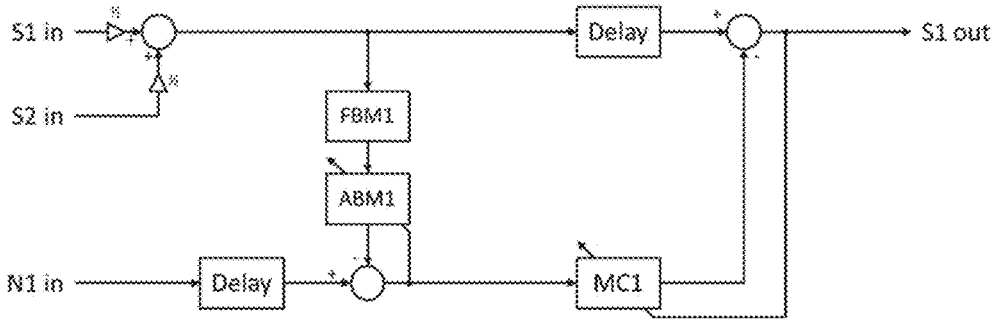
Figure 3D:
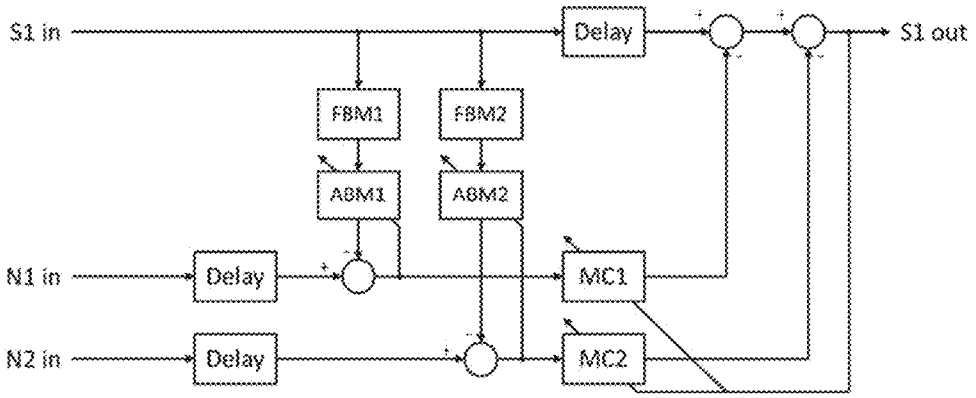
Figure 3E:
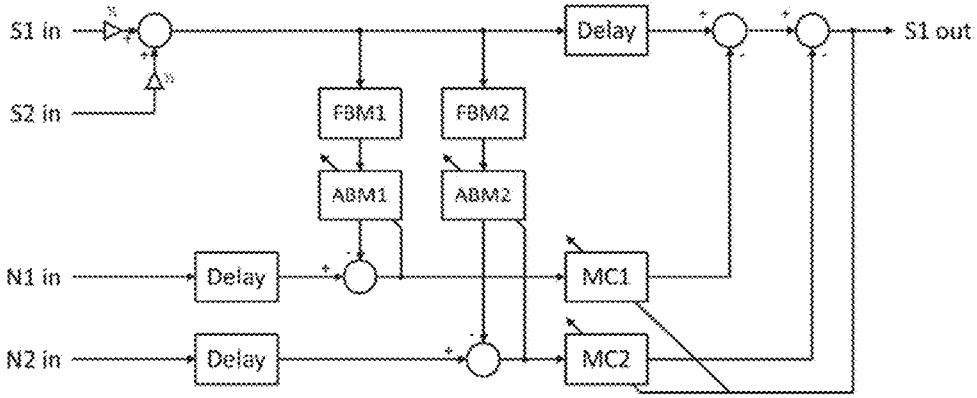
Figure 3F:
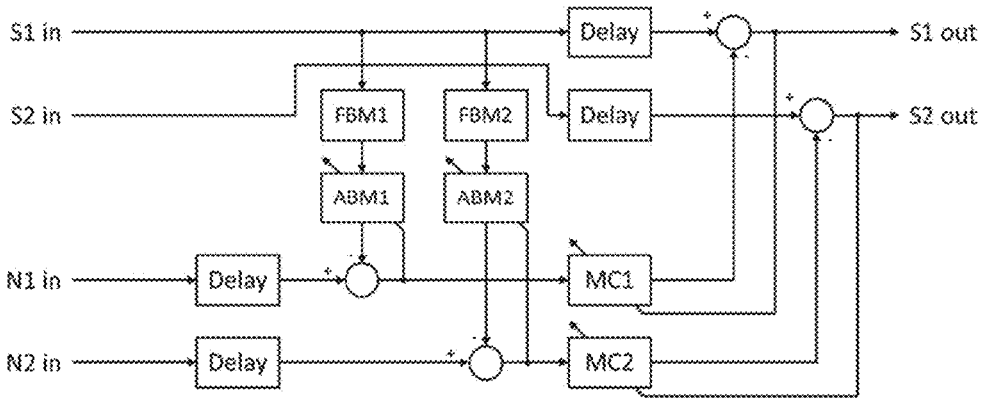
Figure 3G:
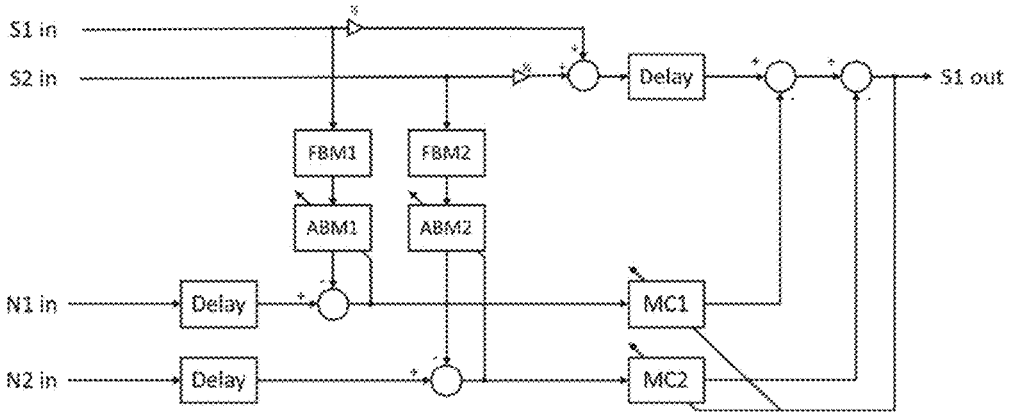

FIG. 3*a* shows Mode 1 for the GSC 240, which is applied in the case of there being one speech input (s1), one noise input (n1), one output (s1). FIG. 3*b* shows Mode 2 for the GSC 240, which is applied in the case of there being two inputs (s1 & s2), speech=50:50 mix, noise=difference. FIG. 3*c* shows Mode 3 for the GSC 240, which is applied in the case of there being two speech inputs (s1, s2) 50:50 mix, one noise input (n1), one output (s1). FIG. 3*d* shows Mode 4 for the GSC 240, which is applied in the case of there being one speech input (s1), two noise inputs (n1, n2), one output (s1). FIG. 3*e* shows Mode 5 for the GSC 240, which is applied in the case of there being two speech inputs (s1, s2) 50:50 mix, two noise inputs (n1, n2), one output (s1). FIG. 3*f* shows Mode 6 for the GSC 240, which is applied in the case of there being two speech inputs (s1, s2), two noise inputs (n1, n2), two outputs (s1, s2). FIG. 3*g* shows Mode 7 for the GSC 240, which is an alternative mode to Mode 5, which may be applied in the case of there being two speech inputs (s1, s2), two noise inputs (n1, n2), and one output (s1). Mode 7 in some embodiments may supersede Mode 5, and Mode 5 may be omitted in such embodiments, as Mode 7 has been found to provide a GSC which causes less speech distortion than is the case for Mode 5. Mode 7 may thus be particularly applicable in neckband headsets and earbud headsets.

Modes 1-3 comprise a single adaptive Main (side-lobe) canceller, with blocking matrix stage suiting the number and type of mic inputs. Modes 4 & 5 comprise a dual path Main canceller stage, with two noise references being adaptively filtered, and applied to cancel noise in a single speech channel, resulting in one speech output. Mode 6 effectively duplicates mode 1, comprising two independent 2-mic GSCs, with two uncorrelated speech outputs.

In FIGS. 3*a*-3*g* all adaptive filters are applied as time-domain FIR filters, with the Blocking Matrix running adaptation control using subband NLMS.

The GSC 240 implements a configurable dual Generalised Sidelobe Canceller (GSC). It takes multiple microphone signal inputs, and attempts to extract speech by cancelling the undesired noise. As per standard GSC topology, the underlying algorithm employs a two stage process. The first stage comprises a Blocking Matrix (BM), which attempts to adapt one or more FIR filters to remove desired speech signal from the noise input microphones. The resulting "noise reference(s)" are then sent to the second stage "Main Canceller" (MC), often referred to as Sidelobe Canceller. This stage combines the input speech Mic(s) and noise references from the Blocking Matrix stage, and attempts to cancel (or minimise) noise from the output speech signal.

However, unlike conventional GSC operation, the GSC 240 can be adaptively configured to receive up to four microphones' signals as inputs, labelled as follows: S1—Speech Mic 1; S2—Speech Mic 2; N1—Noise Mic 1; N2—Noise Mic 2. The module is designed to be as configurable as possible, allowing a multitude of input configurations, depending on the application in question. This introduces some complexity, and requires the user to specify a usage Mode, depending on the use-case in which the module is being used. This approach enables the module 200 to be used across a range of designs, with up to four microphone inputs. Notably, providing for such modes of use allowed development of a GSC which delivers optimal performance by a single beamformer in relation to different hardware inputs.

The performance of the Blocking Matrix stage (and indeed the GSC as a whole) is fundamentally dependent on the choice of signal inputs. Inappropriate allocation of noise and speech inputs can lead to significant speech distortion, or at worst, complete speech cancellation. The present embodiment further provides for a tuning tool which presents a simple GUI, and which implements a set of rules for routing and configuration, in order to allow an Engineer developing a particular headset to easily configure the system 200 to their choice of microphone positions.

Figure 4A:
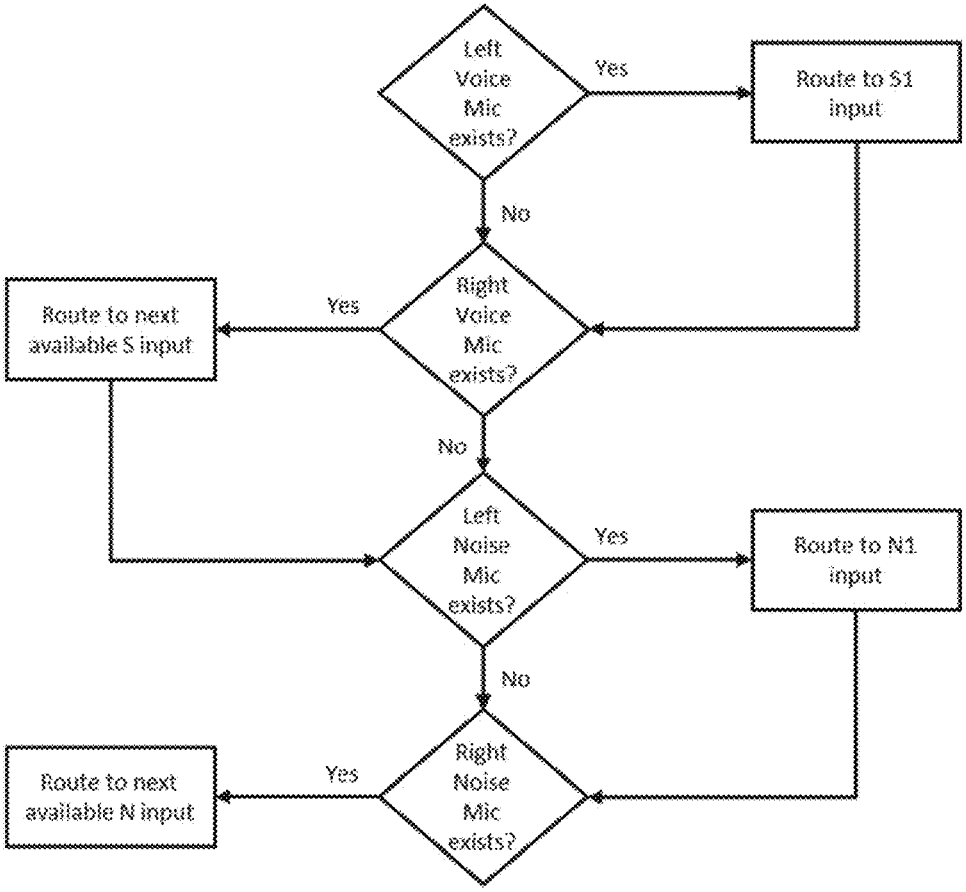
FIG. 4*a* illustrates the tuning tool rules for configuring microphone routing to the generalised sidelobe canceller of the system of FIG. 2.

FIG. 4*a* illustrates the tuning tool rules for configuring microphone router 210 to establish such inputs to the GSC for a given headset form factor. s1 is input speech reference #1, and is normally connected to the best input speech mic or source (ie. mic closer to the mouth). n1 is the input noise reference #1, normally connected to the best input noise mic or source (ie. furthest mic from the mouth/speech source). s2 is the input speech reference #2, and n2 is the input noise reference #2.

Figure 4B:
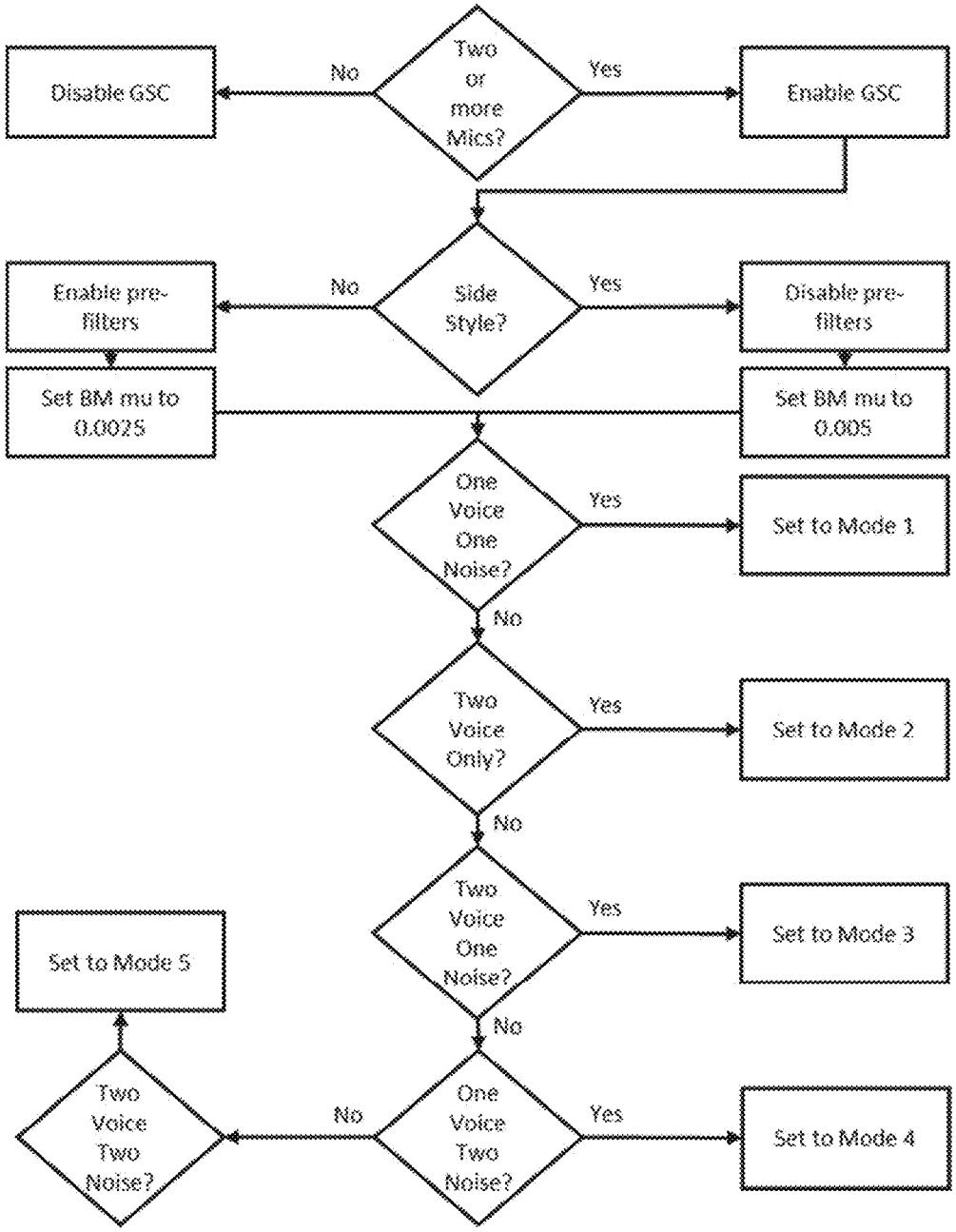
FIG. 4*b* illustrates the tuning tool rules for configuring the generalised sidelobe canceller of the system of FIG. 2.

FIG. 4*b* illustrates the tuning tool rules for configuring the GSC including selection of a suitable Mode from FIG. 3. In this tuning tool mode 6 of FIG. 3*f* is not used, however in alternative embodiments the tuning tool may adopt mode 6 as a stereo mode.

Importantly, adaptation of both the Blocking Matrix and Main Canceller filters should only occur during appropriate input conditions. Specifically, BM adaptation should occur only during known good speech, MC adaptation should occur only during non-speech. These adaption control inputs are logically mutually exclusive, and this is a key reason for integration of the VAD elements (220, 222, 224, 226, 230) with the GSC 240 in this embodiment.

Figure 5:
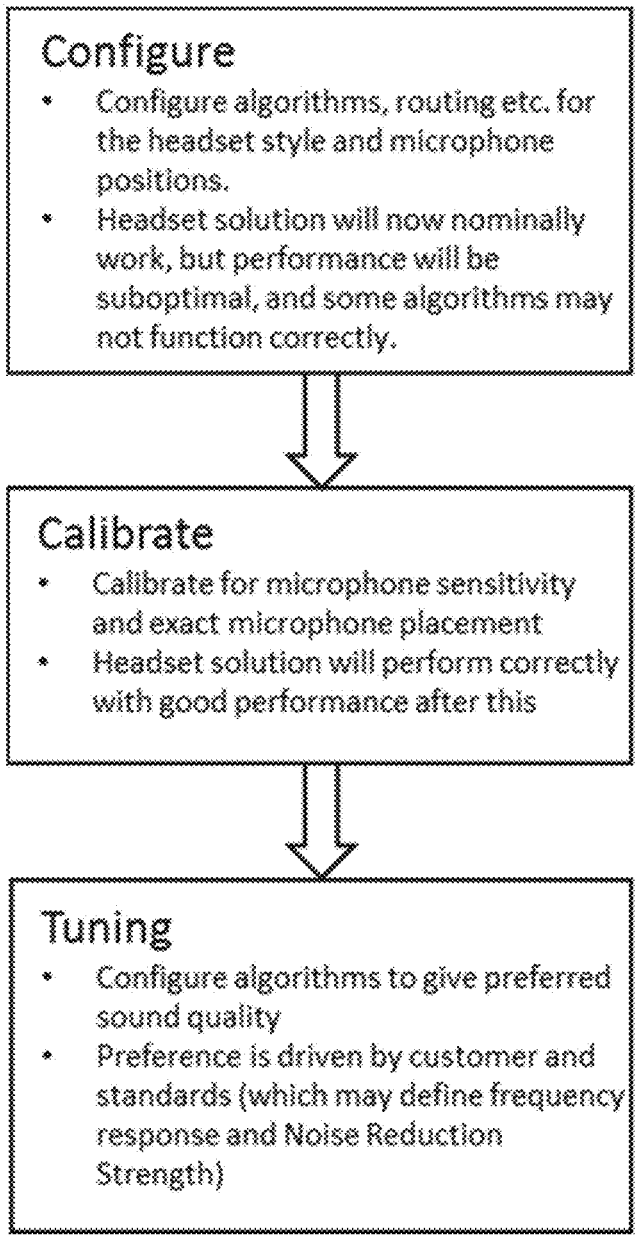
FIG. 5 illustrates the fitting process for the system of FIG. 2.

A further aspect of the present embodiment of the invention is that the generalised applicability of the GSC means that it is not feasible to write dedicated code to implement front end beamformer(s) to undertake front end "cleaning" of the speech and/or noise signals, as such code requires knowledge of microphone positions and geometries. Instead the present embodiment provides for a fitting process as shown in FIG. 5. In a calibration stage, the GSC is allowed to adapt to speech while the specific headset is on a HATS or person, so that all variables in the GSC train towards a good solution for that headset in ideal (no noise) speech conditions. This allows the GSC variables to train to the situation where there is only speech present. This trained filter's settings are then copied into the fixed block matrix (FBMn) for the GSC and remain fixed throughout subsequent device operation, with the respective adaptive block matrix (ABMn) effecting the incremental adaptivity required for normal GSC operation. As mentioned elsewhere herein, in some configurations the FBM is not used, such as in the side pendant headset form factor where the FBM is not used because the path between the microphones varies too much due to pendant movement during use. This approach means that not only does the FBMn obviate the need for dedicated beamformer code, but it also serves the function of fixed front end microphone matching, as it is trained to achieve this effect in the ideal speech condition. Moreover, the ABMn effects the role of adaptive microphone matching, so as to compensate for differences between microphones that vary from one headset to another due to manufacturing tolerances. Together, this means that system 200 does not require front end microphone matching. Eliminating front end beamformers and front end microphone matching is another important element in enabling the present embodiment to be widely flexible to many different headset form factors. In turn, the heavy reliance placed on performance of the two part block matrix achieving these tasks motivated a very finely tuned GSC, and the use of a frequency domain NLMS in the block matrices is one manner in which such GSC performance can be effected.

As usual, in each GSC mode the adaptation control for the Main Canceller (MC) noise canceller adaptive filter stage is also controlled externally, to only allow MC filter adaptation during non-speech periods as identified by decision module 230.

GSC 240 may also operate adaptively in response to other signal conditions such as acoustic echo, wind noise, or a blocked microphone, as may be detected by any suitable process.

The present embodiment thus provides for an adaptive front end which can operate effectively despite a lack of microphone matching and front end processing, and which has no need for forward knowledge of headset geometry.

Figure 6:
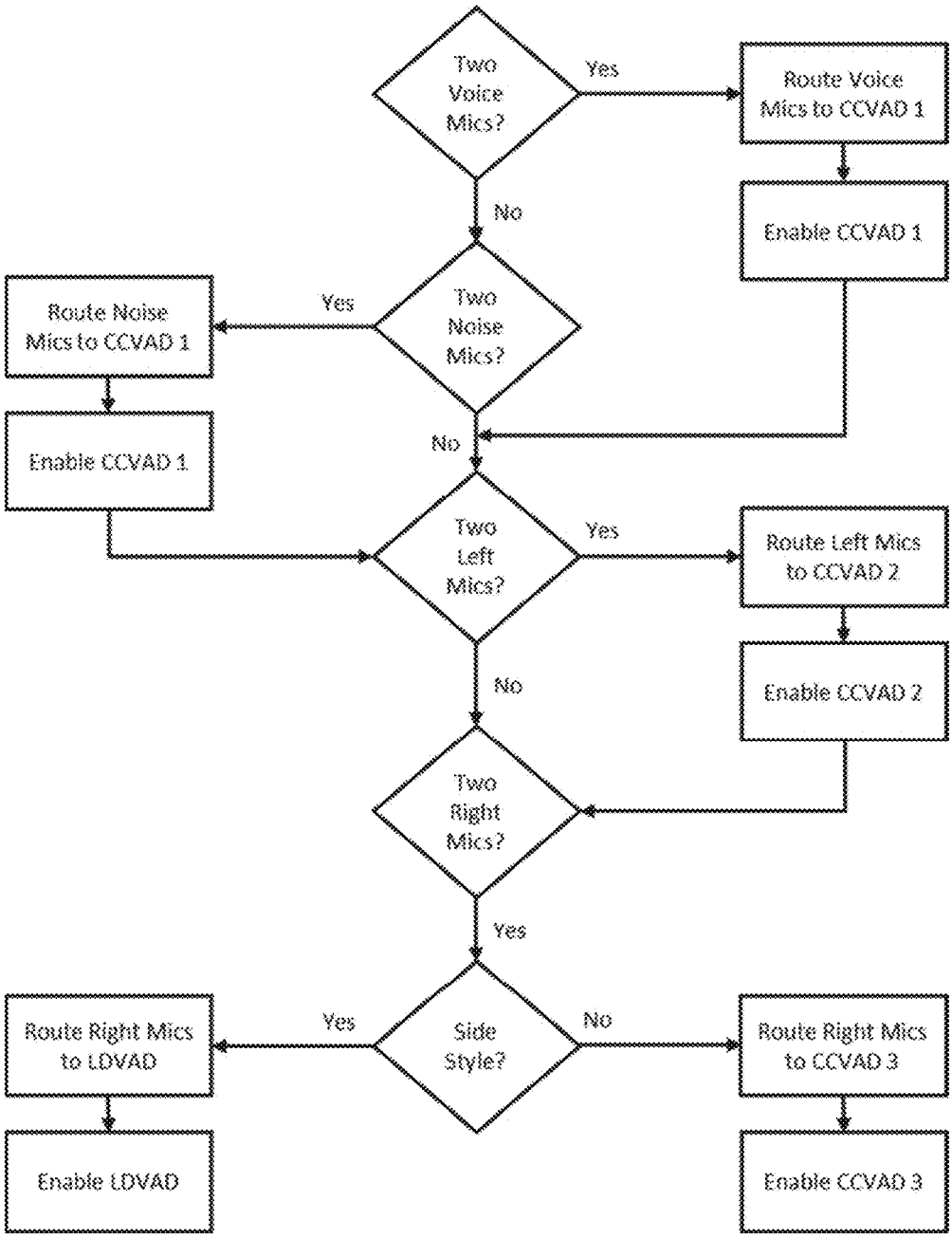
FIG. 6 illustrates the voice activity detection (VAD) routing configuration process for the system of FIG. 2.
Figure 7:
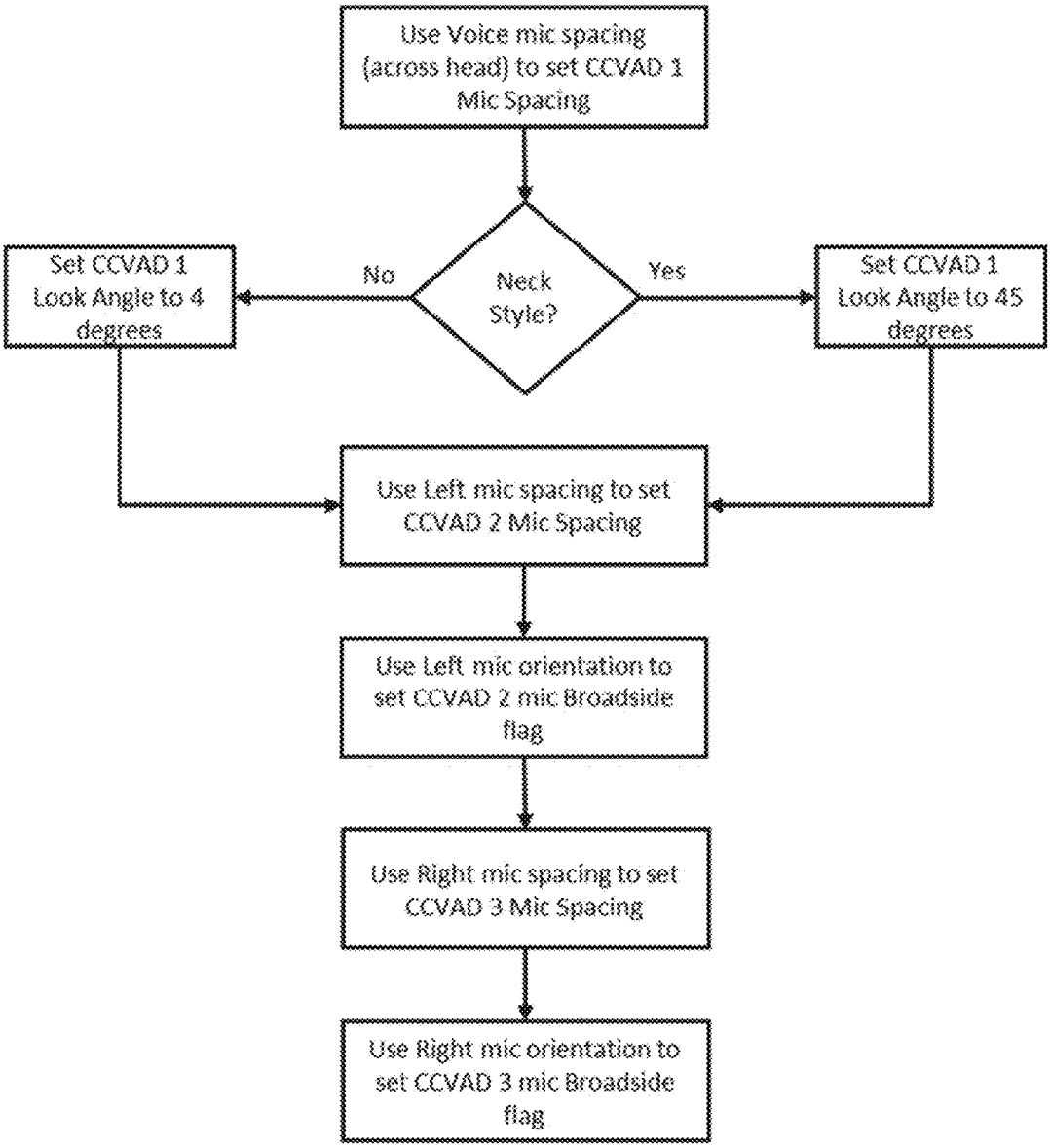
FIG. 7 illustrates the VAD configuration process for the system of FIG. 2.

Referring again to FIG. 2, system 200 further comprises a configuration register 260. The configuration register stores parameters to control the router 210 input-output mapping, the logic of the truth table 230, parameters of architecture of the GSC 240, and parameters associated with the VADs 220, 222, 224, 226 (as illustratively indicated by the unconnected arrows extending from register 260 in FIG. 2). The fitting process to produce such configuration settings is shown in FIG. 5. The VAD routing configuration process to configure the microphone router 210 to appropriately route microphone inputs to the VADs is shown in FIG. 6. The VAD configuration process implemented by the tuning tool is shown in FIG. 7. In FIG. 7 the CCVAD1 Look Angle is set to 4 degrees if the headset is not a neck style form factor, which is not a critical value but happens to give a +/− one sample offset for a headset having a microphone on each ear, and is also a value which performs sufficiently well even when the position in which the headset is worn is adjusted. Configuration Parameters are those values that are set or read external to the algorithm. These fall into three types: Build Time, Run Time and Read Only. Build Time Parameters are set once when the algorithm is being built and linked into a solution. These are typically related to the aspects of the solution that don't change at runtime, but which affect the operation of the algorithm (such as block size, FFT frequency resolution). Build Time Parameters are often set by #defines in C code. Run Time Parameters are set at run time (usually by the tuning tool). It may not be possible to change all of these parameters while the algorithm is actually running, but it should at least be possible to change them while the algorithm is paused. A lot of these parameters are set in real world values, and may need to be converted to a value that can be used by the DSP. This conversion will often happen in the tuning tool. It could also be performed in the DSP, however careful thought needs to be given to the increase in processing power required to do this. Read Only parameters can't be set external to the algorithm, but can be read. These parameters can be read by other algorithms, and (in some situations) by the tuning tool for display in the user interface.

Other embodiments of the invention may take the form of a GUI based tuning tool that takes information about a headset configuration from a person who does not have to understand the details of all of the underlying algorithms and blocks, and which is configured to reduce such input into a set of configuration parameters to be held by register 260. In such embodiments the customisation, or tuning, of the voice-capture system 200 to a given headset platform and microphone configuration is facilitated by the tuning tool, which can be used to configure the solution to work optimally for a wide range of microphone configurations such as those shown in FIG. 1. Thus, the described embodiment of the invention provides a single system 200 that can be applied to all the common microphone positions encountered on a headset, and which can be simply configured for optimal performance with a simple tuning tool.

Thus an architecture is presented that addresses the issue of variable headset form factor through careful selection of algorithms and through the use of a reconfigurable framework. Simulation results for this architecture show that it is capable of matching the performance of similar headsets with bespoke algorithm design. An architecture has been developed that can cover all of the common microphone positions encountered on a headset and be configured for optimal voice capture performance with a fairly simple tuning tool.

Figure 8:
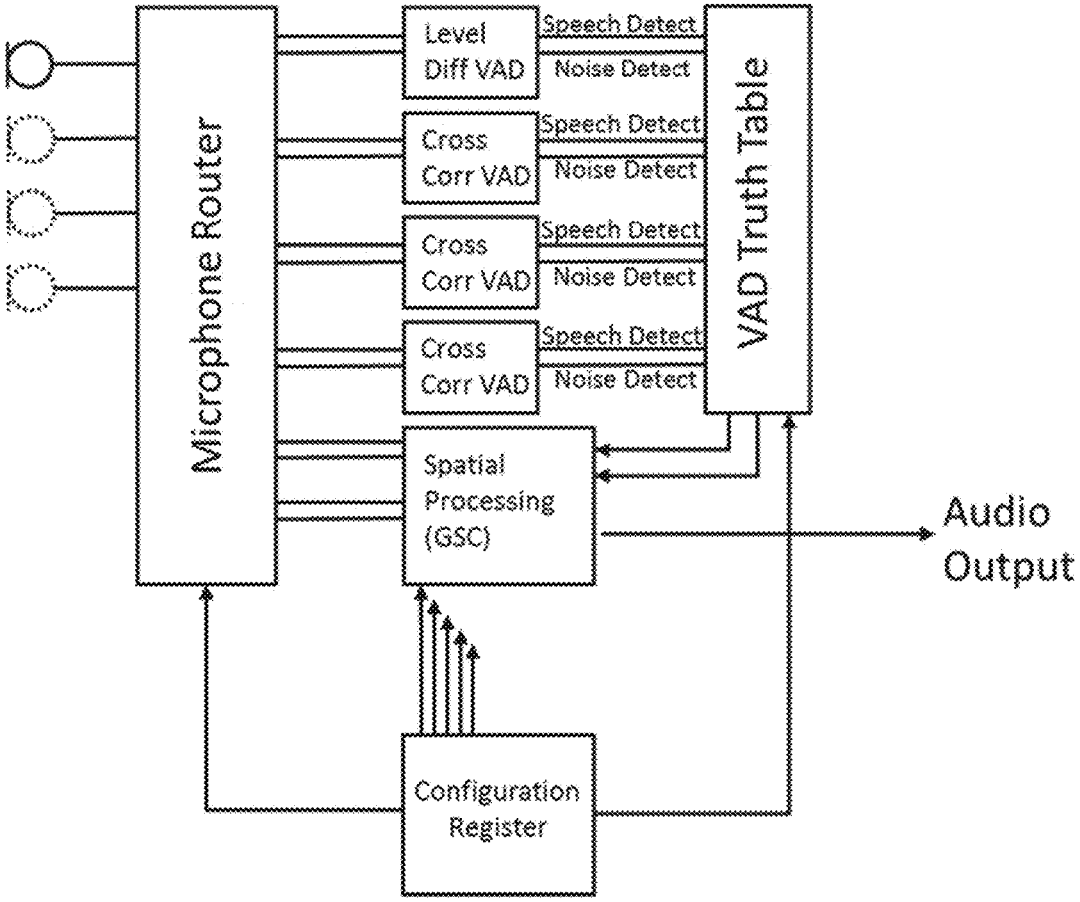
FIG. 8 illustrates the architecture of a configurable system for front-end voice capture in accordance with another embodiment of the invention.

FIG. 8 illustrates an alternative embodiment, in which like elements to the embodiment of FIG. 2 are not described again. However this embodiment omits back end noise reduction, which in some cases may be a suitable form in which the adaptive system may be shipped with the expectation that noise reduction will be implemented separately, or may be an appropriate final architecture if used for automatic speech recognition (ASR). This reflects that ASR typically performs best on signals without back end noise reduction due to its ability to tolerate such noise but poor tolerance of the dynamic rebalancing typically introduced by spectral noise reduction.

Reference herein to a "module" or "block" may be to a hardware or software structure configured to process audio data and which is part of a broader system architecture, and which receives, processes, stores and/or outputs communications or data in an interconnected manner with other system components.

Reference herein to wireless communications is to be understood as referring to a communications, monitoring, or control system in which electromagnetic or acoustic waves carry a signal through atmospheric or free space rather than along a wire or conductor.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not limiting or restrictive.

The invention claimed is:

1. A signal processing device for configurable voice activity detection, the device comprising:

a plurality of inputs for receiving respective microphone signals;

a microphone signal router for routing microphone signals from the inputs;

at least one voice activity detection module configured to receive a pair of microphone signals from the microphone signal router, and configured to produce a respective output indicating whether speech or noise has been detected by the voice activity detection module in the respective pair of microphone signals;

a voice activity decision module for receiving the output of the at least one voice activity detection module and for determining from the output of the at least one voice activity detection module whether voice activity exists in the microphone signals, and for producing an output indicating whether voice activity exists in the microphone signals;

a spatial noise reduction module for receiving microphone signals from the microphone signal router, and for performing adaptive beamforming based in part upon the output of the voice activity decision module, and for outputting a spatial noise reduced output.

2. The signal processing device of claim 1, wherein the spatial noise reduction module comprises a generalised sidelobe canceller module.

3. The signal processing device of claim 2, wherein the generalised sidelobe canceller module is provided with a plurality of generalised sidelobe cancellation modes, and is configurable to operate in accordance with one of said modes.

4. The signal processing device of claim 2, wherein the generalised sidelobe canceller module comprises a block matrix section comprising:

a fixed block matrix module configurable by training; and an adaptive block matrix module operable to adapt to microphone signal conditions.

5. The signal processing device of claim 1, further comprising a plurality of voice activity detection modules.

6. The signal processing device of claim 5, comprising four voice activity detection modules.

7. The signal processing device of claim 5, comprising at least one level difference voice activity detection module, and at least one cross correlation voice activity detection module.

8. The signal processing device of claim 6, comprising one level difference voice activity detection module, and three cross correlation voice activity detection modules.

9. The signal processing device of claim 1 wherein the voice activity decision module comprises a truth table.

10. The signal processing device of claim 1 wherein the voice activity decision module is fixed and non-programmable.

11. The signal processing device of claim 1 wherein the voice activity decision module is configurable when fitting voice activity detection to the device.

12. The signal processing device of claim 1 wherein the voice activity decision module comprises a voting algorithm.

13. The signal processing device of claim 1 wherein the voice activity decision module comprises a neural network.

14. The signal processing device of claim 1, wherein the device is a headset.

15. The signal processing device of claim 1, wherein the device is a master device interoperable with a headset.

16. The signal processing device of claim 15, wherein the master device is a smartphone or a tablet.

17. The signal processing device of claim 1, further comprising a configuration register storing configuration settings for one or more elements of the device.

18. The signal processing device of claim 1, further comprising a back end noise reduction module configured to apply back end noise reduction to an output signal of the spatial noise reduction module.

19. A method for configuring a configurable front end voice activity detection system, the method comprising:

training an adaptive block matrix of a generalised sidelobe canceller of the system by presenting the system with ideal speech detected by microphones of a headset having a selected form factor; and copying settings of the trained adaptive block matrix to a fixed block matrix of the generalised sidelobe canceller; wherein:

the generalised sidelobe canceller module comprises a block matrix section comprising: a fixed block matrix module configurable by training; and the adaptive block matrix module is operable to adapt to microphone signal conditions.

20. A non-transitory computer readable medium for fitting a configurable voice activity detection device, the computer readable medium comprising instructions which, when executed by one or more processors, causes performance of the following:

configuring routing of microphone inputs to voice activity detection modules, wherein the voice activity detection module is configured to receive a pair of microphone signals from the microphone signal router, and configured to produce a respective output indicating whether speech or noise has been detected by the voice activity detection module in the respective pair of microphone signals; and configuring routing of microphone inputs to a spatial noise reduction module, wherein the spatial noise reduction module comprises a generalised sidelobe canceller module.

* * * * *